US006256888B1

(12) United States Patent
Shuen

(10) Patent No.: US 6,256,888 B1
(45) Date of Patent: Jul. 10, 2001

(54) FOLDABLE KNIFE

(75) Inventor: Shun-Tian Shuen, San Chung (TW)

(73) Assignee: Janchy Enterprise Co., Ltd., San Chung (TW)

( * ) Notice: Subject to any disclaimer, the term of this patent is extended or adjusted under 35 U.S.C. 154(b) by 0 days.

(21) Appl. No.: 09/516,225

(22) Filed: Mar. 1, 2000

(51) Int. Cl.[7] ..... B26B 1/04
(52) U.S. Cl. ..... 30/161; 30/160
(58) Field of Search ..... 30/160, 161, 519

(56) References Cited

U.S. PATENT DOCUMENTS 5,495,674 * 3/1996 Taylor ..... 30/160
5,737,841 * 4/1998 McHenery et al. ..... 30/160
5,822,866 * 10/1998 Pardue ..... 30/160 X
5,979,065 * 11/1999 Hsu ..... 30/161 X

* cited by examiner

*Primary Examiner*—Douglas D. Watts
(74) *Attorney, Agent, or Firm*—Bacon & Thomas, PLLC

(57) ABSTRACT

Knife structure employing a push button and a slide block drivingly connected with the push button. An engaging plate is disposed in the knife grip and controlled by the push button. The knife blade is formed with multiple locating notches for the engaging plate to engage therein and permit unfolding the knife blade in a stage by stage manner to provide convenience and safety in use.

5 Claims, 9 Drawing Sheets

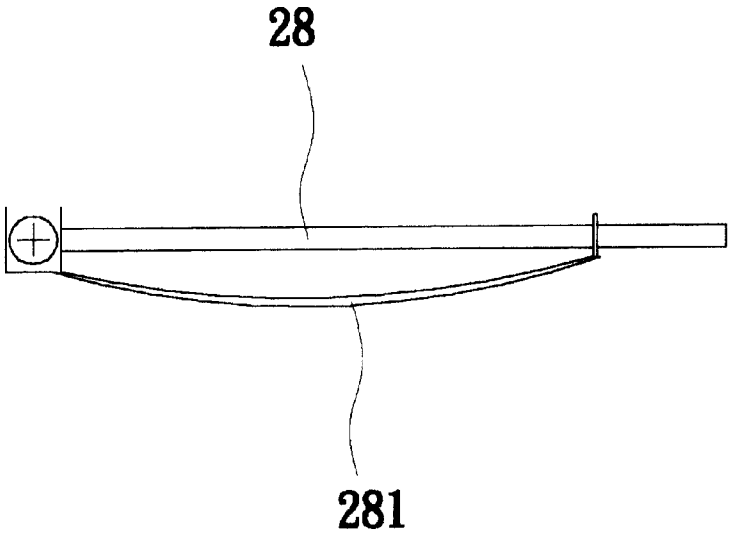
Fig 8-B
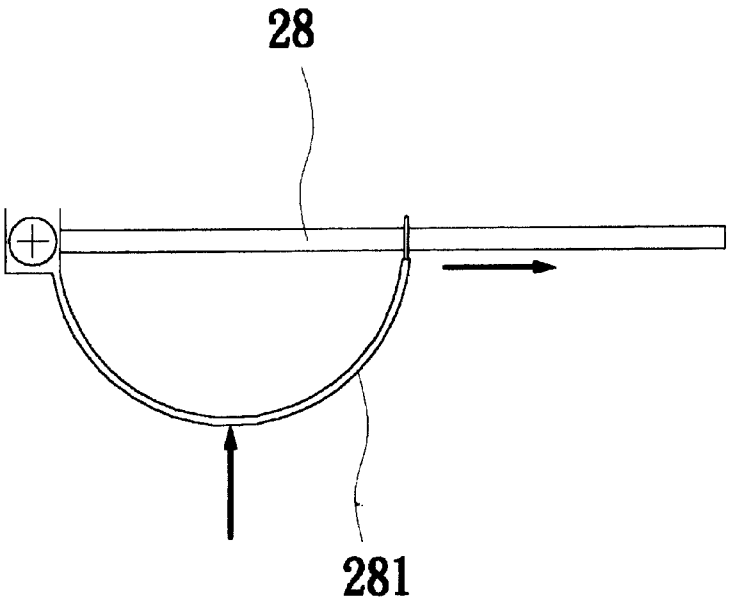
Fig 8-A

FOLDABLE KNIFE

BACKGROUND OF THE INVENTION

The present invention relates to a foldable knife structure in which the knife blade may be automatically controllably unfolded in a stage by stage manner for convenience and safety in use.

There are various kinds of knives with different dimensions and patterns for different uses. For example, a chopper knife is used to cut meat or vegetable, a paper knife is used to cut paper or pare a pencil, a spring knife is used in mountaineering, a hatchet knife is used outdoors, a clasp knife is portable, etc. With respect to a spring knife, a blade is quickly unfolded for use by means of a resilient member. The conventional spring knife is generally designed so that one side of the grip of the knife is pressed to unfold the blade from the other side of the grip into an extended state. Alternatively, the back of the knife may be depressed to unfold the blade.

As shown in FIG. 1, each of the above described conventional knives has a knife grip 2 for receiving the blade 1. When not used, the blade section 10 of the knife blade is hidden in the grip 2 for easy carrying. However, in actual use of the knife, some shortcomings exist in conventional knives as follows:

1. When folding the knife blade into the grip, only a small part of the knife back is exposed to the exterior. Therefore, it is not easy to extend the knives blade. In some knife, the face of the blade near the back thereof is formed with a shallow groove for conveniently drawing out the blade. However, since the blade is made of metal and has a polished face, the shallow groove rends it difficult for a user to easily unfold and extend the blade.
2. The convent ional knife structures lack safety designs for protecting the user, especially the user's hand, from being injured. Especially, with respect to a spring knife, the blade is quickly unfolded by a resilient member. This often leads to accidental cutting or stabbing of the user. Moreover, the resilient member of the spring knife is often designed with a poor position and structure so that after being extended, the blade cannot be quickly and safely folded.

SUMMARY OF THE INVENTION

It is therefore a primary object of the present invention to provide a knife structure employing a push button and a slide block operatively connected with the push button. An engaging plate i s disposed in the knife grip and controlled by the push button. The knife blade is formed with multiple locating notches for engagement by the engaging plate to unfold and extend the knife blade in a stage by stage manner and provide convenience and ensure safety in use.

The present invention can be best understood through the following description and accompanying drawings wherein:

BRIEF DESCRIPTION OF THE DRAWINGS

FIGS. 8A and 8B respectively show the operation of the resilient member of the embodiment of FIG. 7 of the present invention in different stages.

DETAILED DESCRIPTION OF THE PREFERRED EMBODIMENTS

Figure 1:
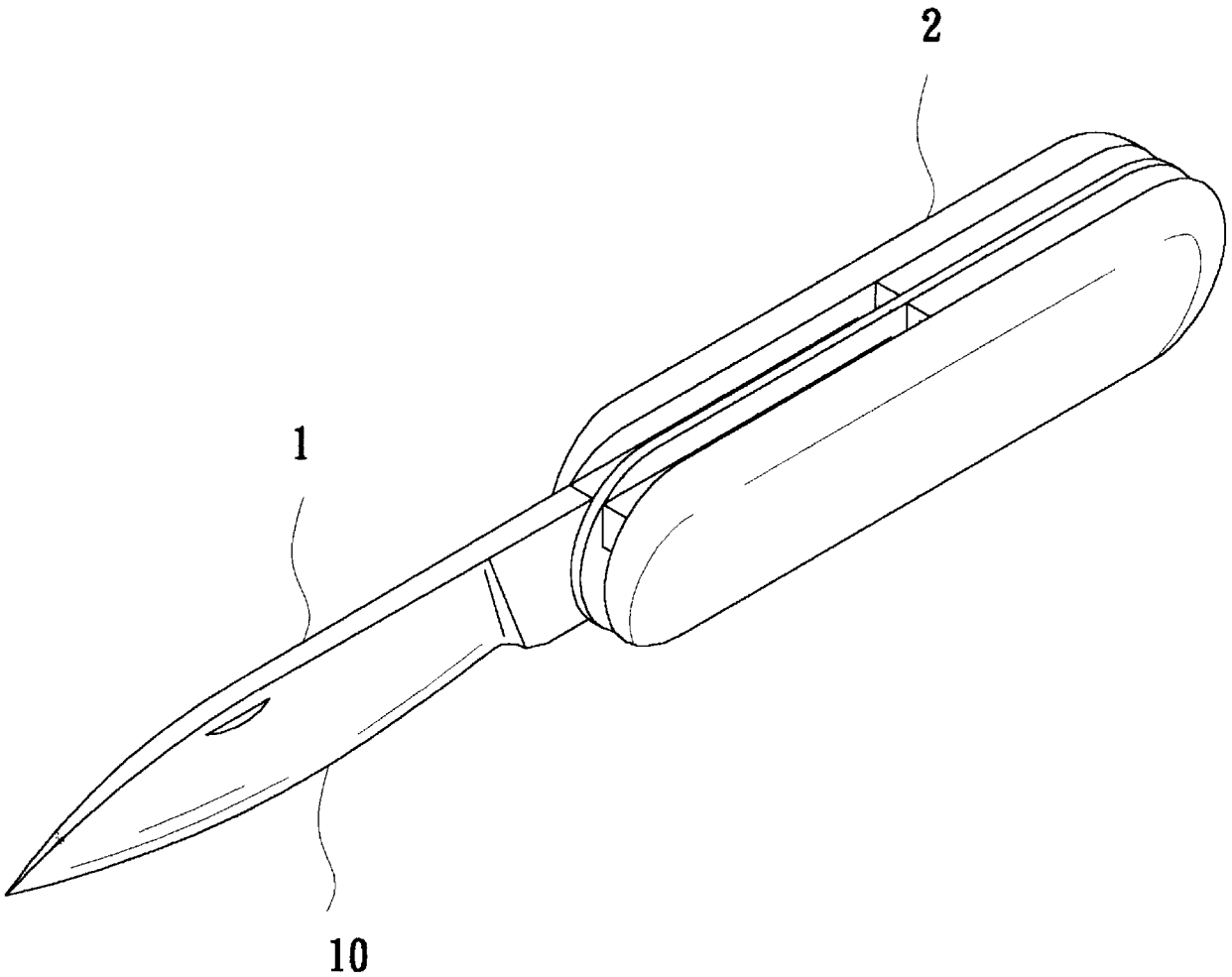
FIG. 1 is a perspective view of a conventional knife.
Figure 2:
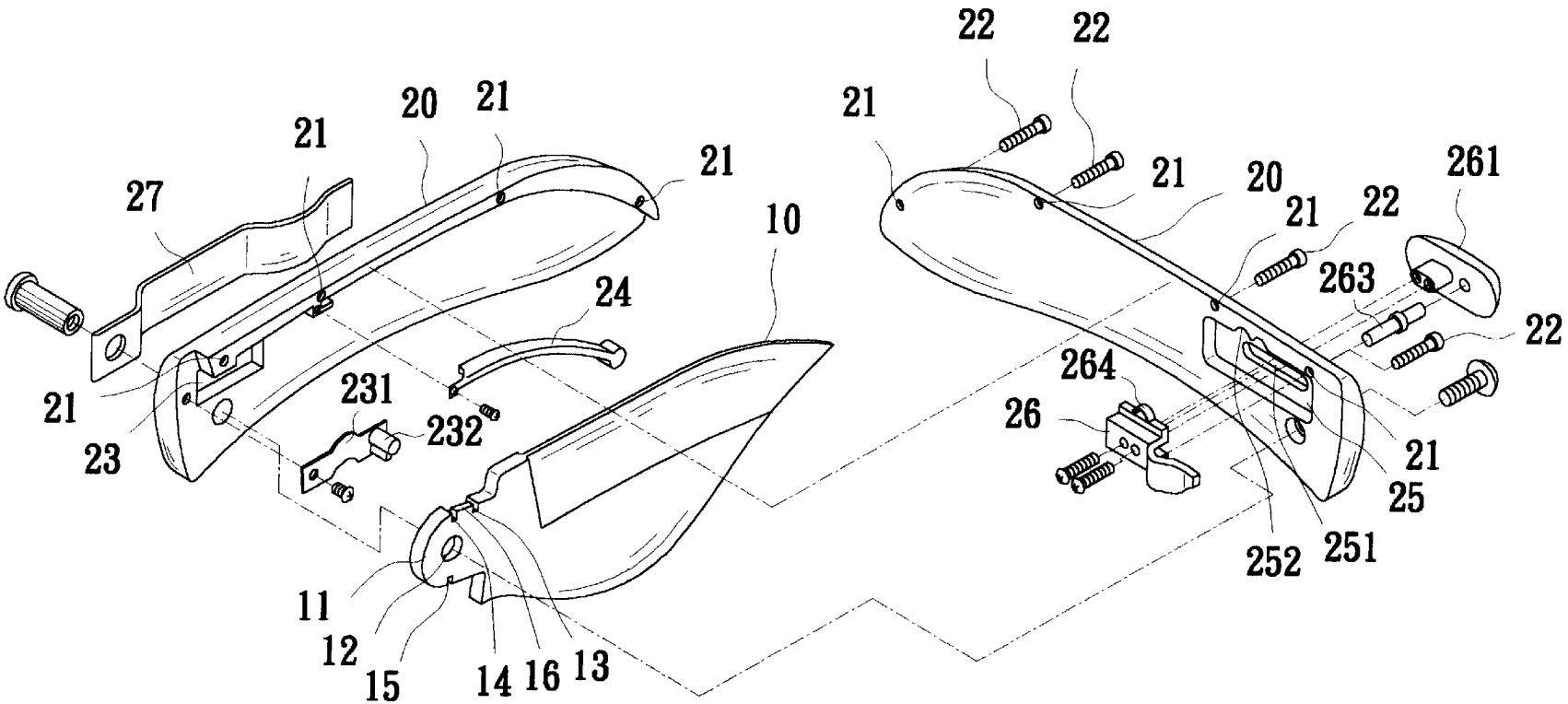
FIG. 2 is a perspective exploded view of the knife structure of the present invention.
Figure 3:
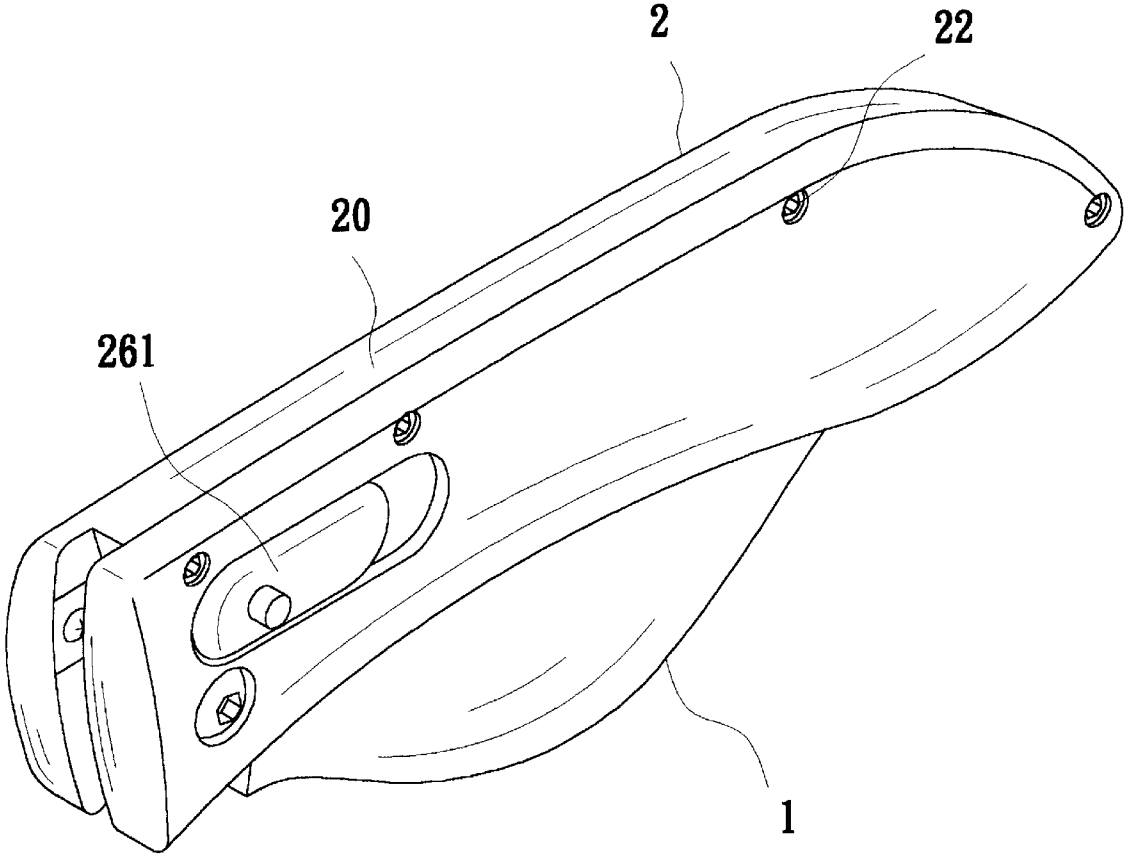
FIG. 3 is a perspective assembled view of the knife structure of the present invention.

Please refer to FIGS. 2 and 3. The knife structure of the present invention includes a knife blade 1 and a knife grip 2. As shown in FIG. 2, the knife blade 1 basically includes a blade section 10 for cutting and a semicircular connecting section 11 at one end. The connecting section 11 is formed with a through hole 12. An edge of the connecting section 11 is formed with a first engaging notch 13, a second engaging notch 14 and a third engaging notch 15. The first engaging notch 13 provides a securing effect when the blade 1 is totally folded into the grip 2. The second engaging notch 14 provides a safety effect for the blade 1 to slowly unfold out. The third engaging notch 15 provides a firm locking effect when the blade 1 and the grip 2 are totally unfolded for cutting an article. In addition, an engaging block 16 is defined between the first and second engaging notches 13, 14. The thickness of the engaging block 16 is less than one half the thickness of the connecting section 11, whereby the blade 1 can be quickly and easily unfolded for use.

As shown in FIG. 2, the grip 2 is composed of two clamping blocks 20 mated with each other. The grip 2 is formed with a profile conforming to a human hand configuration. The peripheries of the opposite inner faces of the clamping blocks 20 are respectively formed with multiple perforations 21 for screws 22 to pass therethrough and lock the clamping blocks 20. The inner face of one end of one of the clamping blocks 20 is formed with a recess 23 and locked with a cantilever-like engaging plate 231 which is permitted to bend to a certain extent. The engaging plate 231 is disposed with a projecting tenon 232. A lateral side of the recess 23 is fixed with an arched resilient member 24. The other clamping block 20 is formed with a slightly larger depression 25 opposite to the recess 23. The center of inner face of the depression 25 is formed with a slot 251. One side of the periphery of the depression 25 is formed with two arched locating notches 252. A slide block 26 is slidably disposed in the depression 25. A push button 261 is disposed on the other outer side of the depression 25 and locked with the slide block 26 by screws. One end of the slide block 26 is disposed with an arched hook section 262. A connecting pin 263 of the push button 261 is passed through the slot 251 to abut against the concave section of the hook section 262. One side of the slide block 26 is disposed with a resilient plate 264 for snugly fitting into the locating notch 252 so as to restrict the slide block 26 from shifting. In addition, the outer surface of the clamping block 20 is disposed with a resilient clamping plate 27 for hanging and clipping the knife. FIG. 3 shows a complete knife structure.

Figure 4:
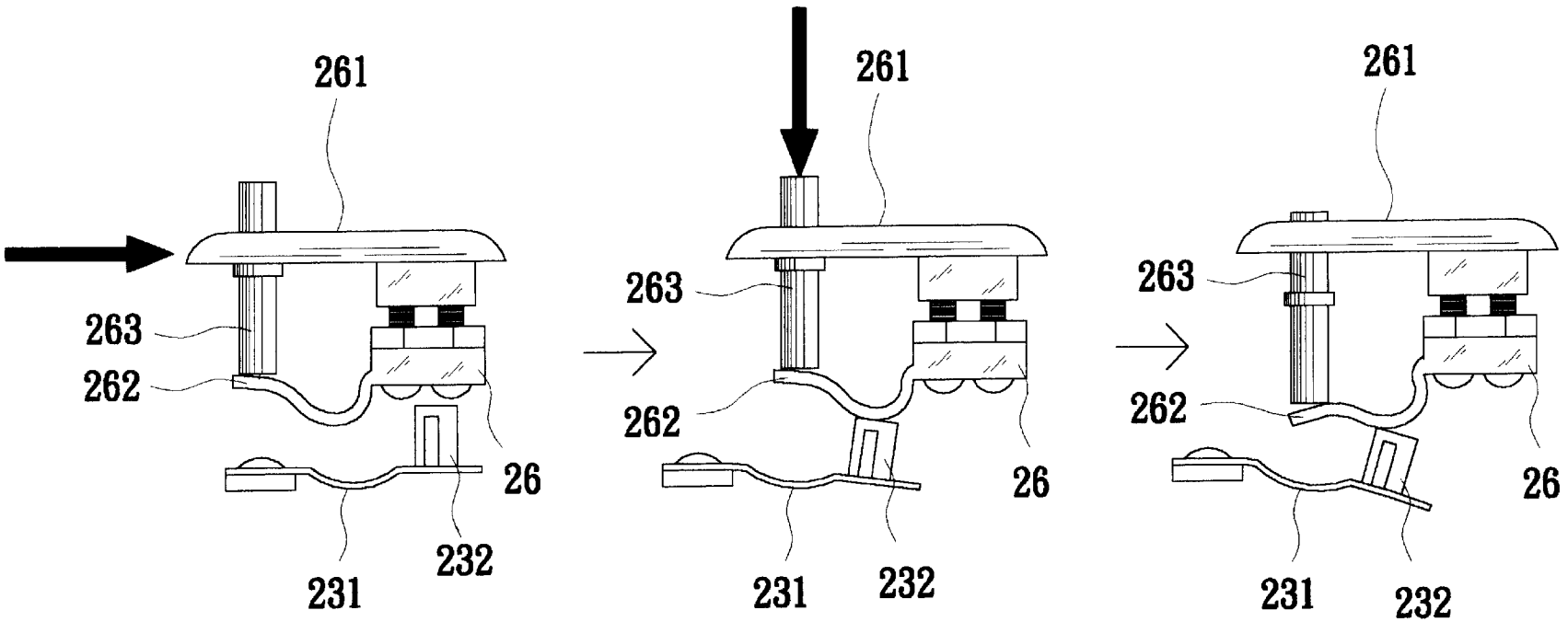
FIGS. 4A, 4B and 4C are plane views respectively showing the operation of the push button and slide block of the knife structure of the present invention in different stages.

FIGS. 4A, 4B, 4C, 5 and 6 show the operation of the present invention. The knife of the present invention can be unfolded in multi-stages with safety. Referring to FIGS. 4A, 4B, 4C, in actual use, when depressing the push button 261

Figure 5:
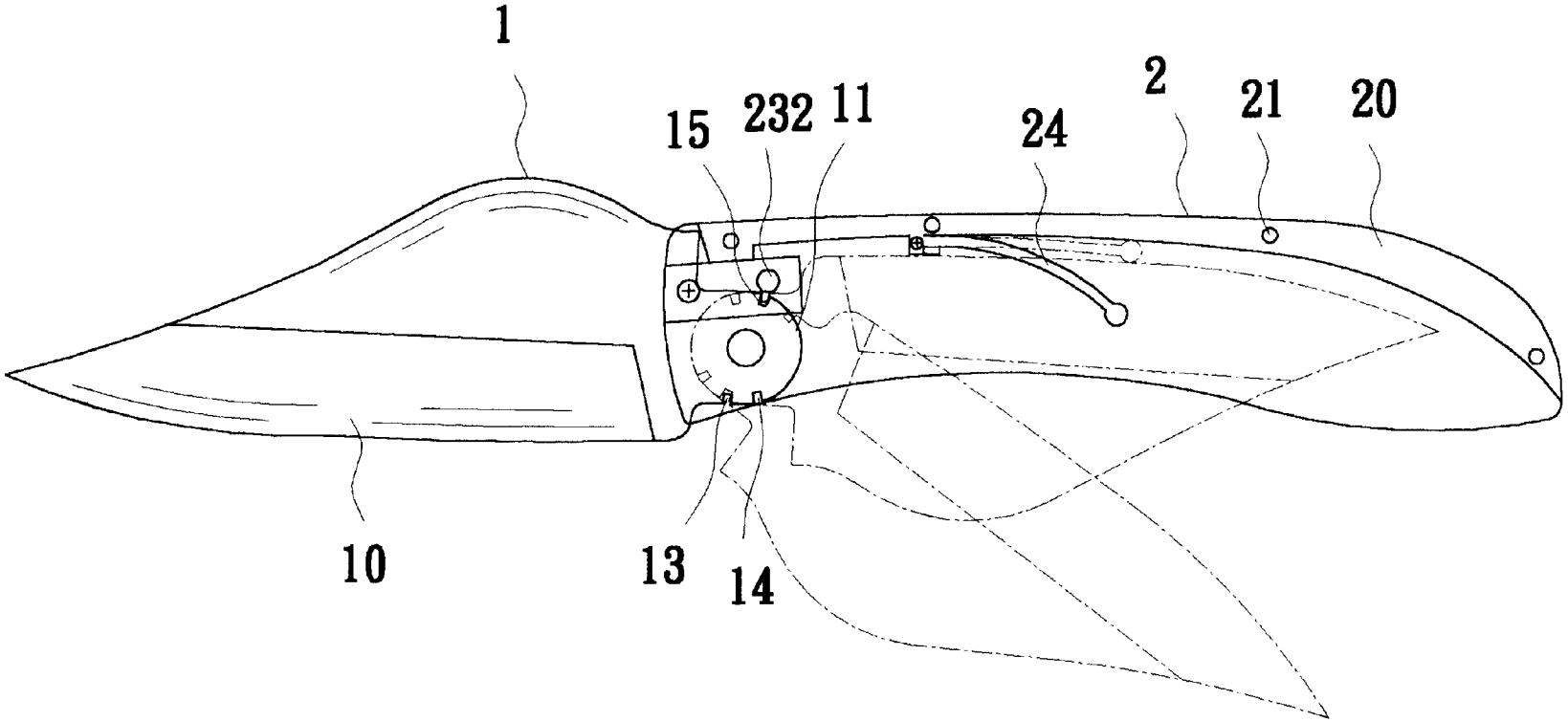
FIG. 5 is a side view showing the unfolding operation of the knife structure of the present invention.
Figure 6:
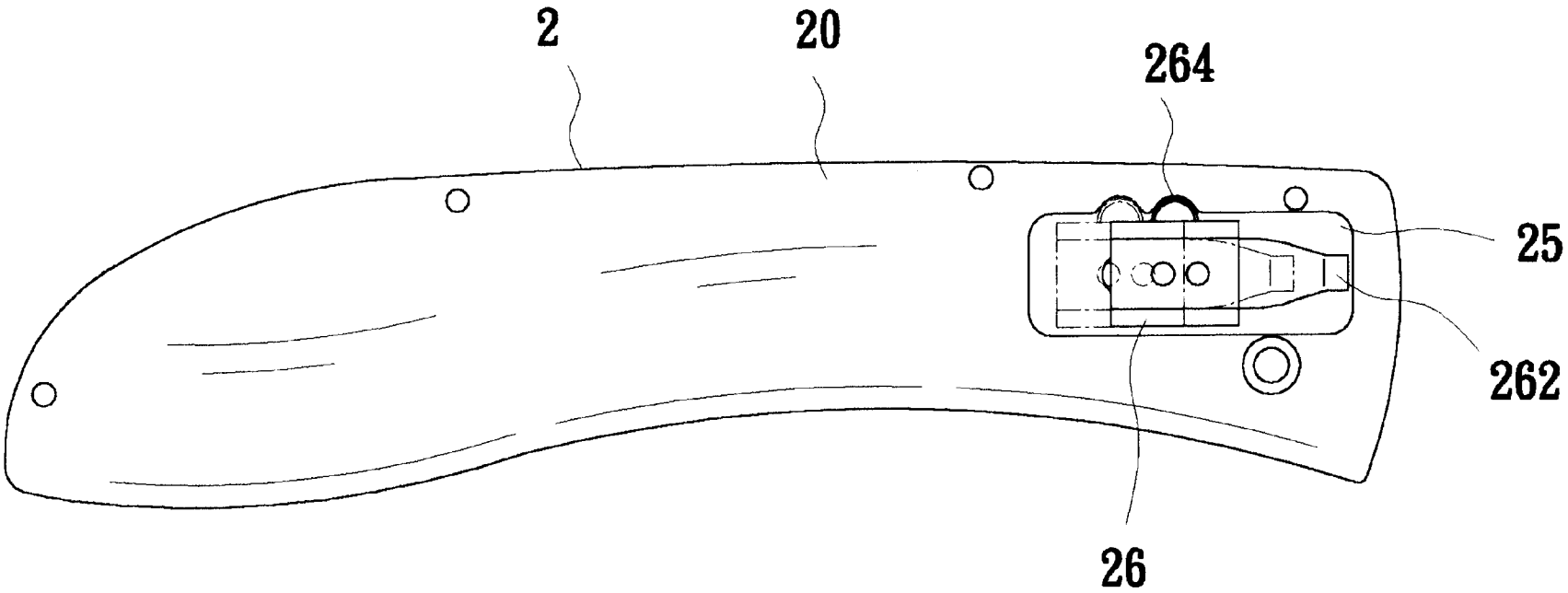
FIG. 6 is a view showing the movement of the slide block inside the knife grip of the knife structure of the present invention.

(as shown in FIG. 4A), via the connecting pin 263, the hook section 262 of the slide block 26 presses the engaging plate 231 downwardly so as to disengage the tenon 232 from the first engaging notch 13 of the blade 1. By means of the resilience of the resilient member 24, the tenon 232 is engaged into the second engaging notch 14 to dispose the blade 1 in a slightly opened state (as shown by phantom line of FIG. 5). Then, the push button 261 is pushed to drivingly shift the slide block 26 (as shown in FIG. 4B) so as to engage the resilient plate 264 on one side of the slide block 26 into the locating notch 252 (as shown in FIG. 6). At this time, the engaging plate 231 is completely pressed by the hook section 262 of the slide block 26 (as shown in FIG. 4C) and the tenon 232 is disengaged from the second engaging notch 14. When the user totally unfolds the blade 1, the tenon 232 is engaged into the third engaging notch 15 so as to locate and lock the blade 1 for cutting an article, as shown in FIG. 5.

The periphery of the connecting section 11 at one end of the blade 1 is formed with the first, second and third notches 13, 14, 15. By means of the push button 261 and the slide block 26 and the specifically designed tenon 232 of the engaging plate 231, the blade 1 is unfolded and located in a stage by stage manner. In addition, the resilient member 24 is disposed in the grip 2 so that the blade 1 can be quickly unfolded out so as to more conveniently and safely use the knife.

Figure 7:
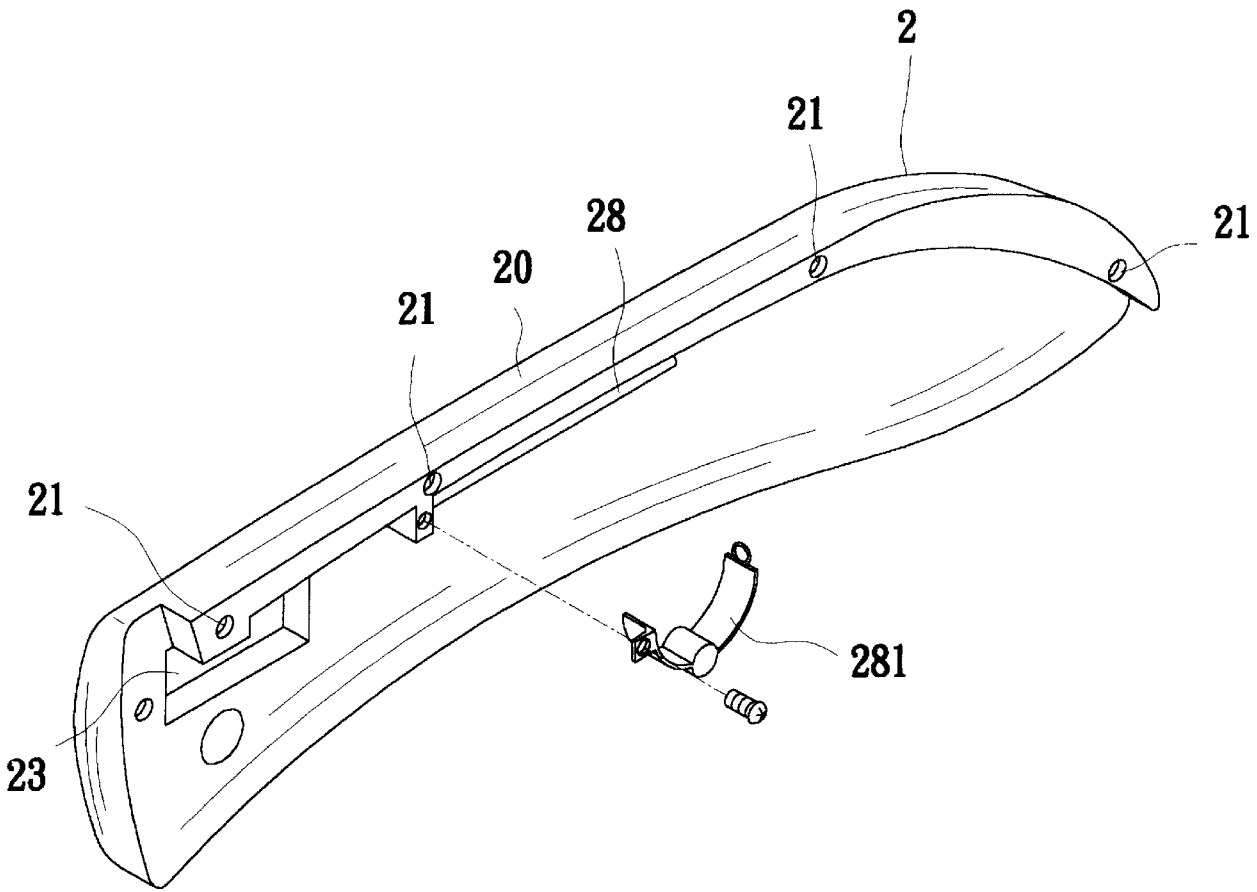
FIG. 7 is a perspective exploded view of another embodiment of the knife structure of the present invention.

Referring to FIG. 7 which shows another embodiment of the unfolding structure for the blade 1, wherein a circular rod 28 and a U-shaped resilient member 281 are disposed on one side of the recess 23 of one of the clamping blocks 20. One end of the resilient member 281 is locked on the clamping block 20, while the other end thereof is formed with a ring-like section for the circular rod 28 to fit therethrough. Accordingly, when folding the blade 1, the blade 1 will press against the resilient member 281 and urge the ring-like end thereof to displace horizontally (as shown in FIGS. 8A and 8B). When unfolding the blade 1, the resilience of the resilient member 281 will quickly unfold and extend the blade 1 out for use.

Figure 9:
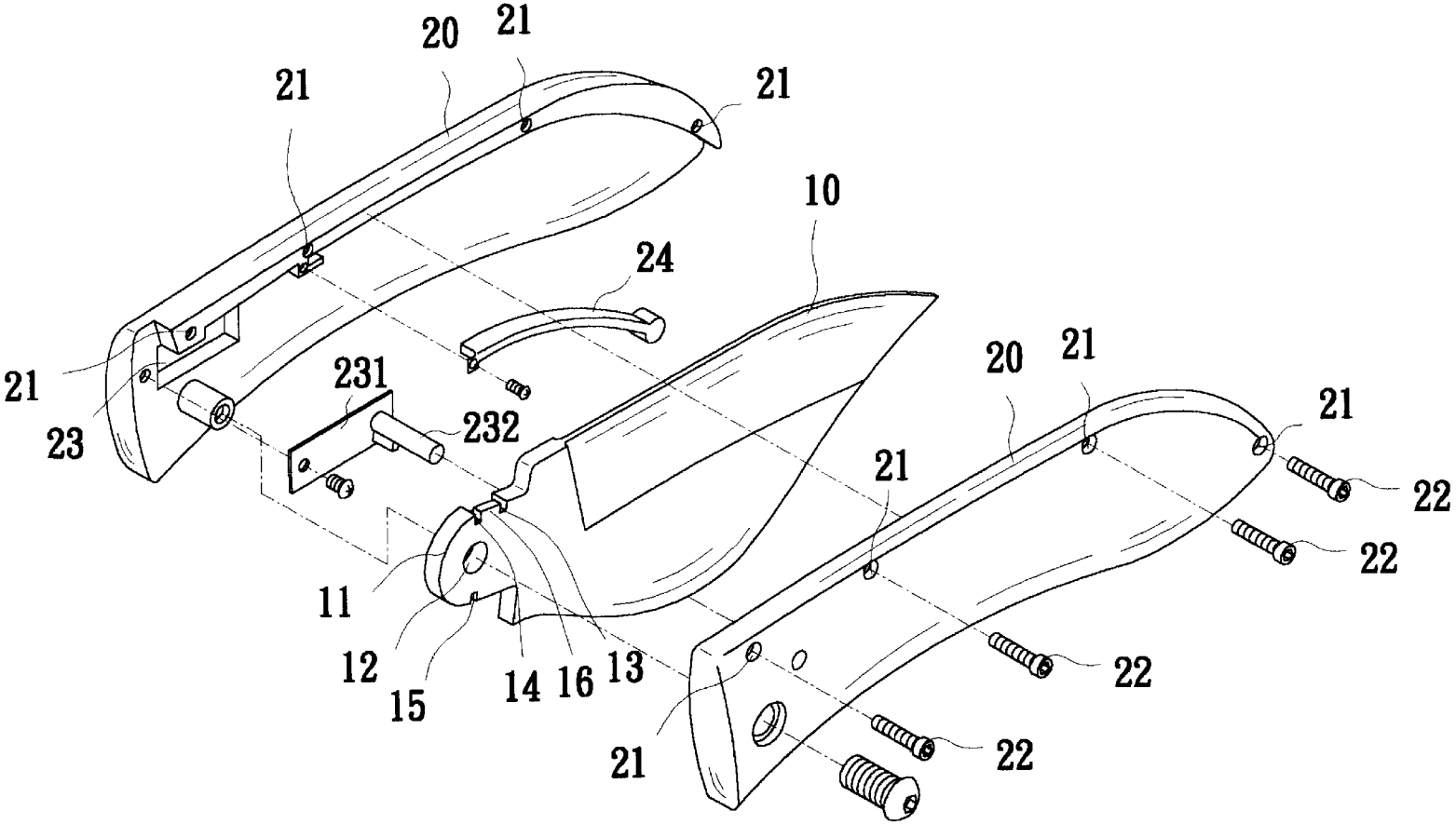
FIG. 9 is a perspective exploded view of still another embodiment of the knife structure of the present invention.

FIG. 9 shows still another embodiment of the present invention, in which the push button safety structure on the grip 2 is omitted. However, the first, second and third engaging notches 13, 14, 15 remain on the periphery of the connecting section 11 at one end of the blade 1. By means of the engaging block 16 defined between the first and second engaging notches 13, 14 and the cooperative resilient member 24 disposed on one side of the recess 23, the blade 1 still can be unfolded out in a stage by stage manner so as to enhance safety in use.

The above embodiments are only used to illustrate the present invention, and are not intended to limit the scope thereof. Many modifications of the above embodiments may be made without departing from the spirit of the present invention.

What is claimed is:

1. A foldable knife comprising:

a knife blade having a blade section and a connecting section at one end of the blade section, the connecting section being formed with a through hole, an edge of the connecting section being formed with a first engaging notch, a second engaging notch and a third engaging notch; and a knife grip composed of two clamping blocks mated with each other, an inner face of one end of one of the clamping blocks being formed with a recess and locked with an engaging plate, the engaging plate being disposed with a projecting tenon, a lateral side of the recess being fixed with a resilient member, an inner face of the other clamping block being formed with a slightly larger depression opposite to the recess, a slide block being slidably disposed in the depression, one end of the slide block being formed with a hook section, a push button being disposed on the other outer side of the depression and locked with the slide block, a connecting pin of the push button abutting against the hook section of the slide block, whereby when depressing the push button, via the connecting pin, the hook section of the slide block presses the engaging plate partially downward to disengage the tenon from the first engaging notch of the blade and by means of the resilience of the resilient member, the tenon is engaged into the second engaging notch, and when the push button is pushed to drivingly shift the slide block so that the hook section presses the engaging plate completely downward the tenon is disengaged from the second engaging notch and engaged into the third engaging notch to totally unfold the blade and the grip.

2. The foldable knife as claimed in claim 1, wherein a clamping plate is disposed on an outer face of the knife grip for hanging or clipping the knife to facilitate the carrying thereof.

3. The foldable knife as claimed in claim 1, wherein one side of an inner wall of the depression of the clamping block is formed with multiple locating notches and a resilient plate is disposed on the slide block corresponding to the locating notches to positively locate the slide block.

4. The foldable knife as claimed in claim 1, wherein an engaging block is defined between the first and second engaging notches of the connecting section of the blade, and the thickness of the engaging block being one half the thickness of the connecting section, whereby the blade may be quickly unfolded into a slightly open state to permit a user to completely unfold the blade.

5. The foldable knife as claimed in claim 1, wherein the resilient member disposed in the grip includes a circular rod and a cooperative U-shaped resilient member, one end of the resilient member being locked on the clamping block, and the other end thereof being formed with a ring-like section for the circular rod to fit therethrough.

* * * * *